US008231335B2

(12) United States Patent
Barker

(10) Patent No.: US 8,231,335 B2
(45) Date of Patent: Jul. 31, 2012

(54) AIR INLET COVER

(75) Inventor: David Barker, Northumberland (GB)

(73) Assignee: Black & Decker Inc., Newark, DE (US)

( * ) Notice: Subject to any disclaimer, the term of this patent is extended or adjusted under 35 U.S.C. 154(b) by 863 days.

(21) Appl. No.: 12/199,859

(22) Filed: Aug. 28, 2008

(65) Prior Publication Data

US 2009/0092499 A1 Apr. 9, 2009

(30) Foreign Application Priority Data

Oct. 4, 2007 (EP) ..... 07117927

(51) Int. Cl.
*F04D 29/70* (2006.01)

(52) U.S. Cl. ..... 415/121.2; 415/214.1; 361/679.51; 361/679.48; 361/695; 361/690

(58) Field of Classification Search ..... 416/247 R; 415/214.1, 121.2; 361/679.51, 679.48, 695, 361/690

See application file for complete search history.

(56) References Cited

U.S. PATENT DOCUMENTS 6,059,541 A * 5/2000 Beckey et al. ..... 417/295
2005/0186070 A1* 8/2005 Zeng et al. ..... 415/211.2

* cited by examiner

*Primary Examiner* — Ajay K Arora
(74) *Attorney, Agent, or Firm* — John Yun

(57) ABSTRACT

In a first aspect, the present invention provides an air inlet cover (1) comprising a grille (2) having a plurality of radial elements (3) radiating from a center of said grille (2), each said radial element (3) comprising a vane (4) having a leading edge (5) for positioning further from a fan and a trailing edge (6) for positioning closer to a fan, the leading edge (5) of each said vane being offset from the respective trailing edge (6) thereof by substantially the same angular amount ($\alpha$) for each said vane (4), whereby the vanes are pitched more steeply closer to the center of said grille (2) than remote from the center of said grille, and a circumferential element (7) comprising a bell-shaped mouth enclosing said vanes (4) and having a plurality of apertures (8) formed in a surface thereof, each respective one of said apertures (8) having a first edge (9) parallel to the pitch of a first respective vane closer to the center of said grille and a second edge (10) parallel to the pitch of a second, adjacent respective vane remote from the center of said grille. In a second aspect, the present invention also provides a power tool comprising a fan and such an air inlet cover (1). The power tool may be a garden leaf blower or a dust extraction machine, including a domestic vacuum cleaner.

11 Claims, 7 Drawing Sheets

AIR INLET COVER

FIELD OF THE INVENTION

This application claims priority to European Patent Application No. EP 07117927.9, filed Oct. 4, 2007. The entire contents of that application are expressly incorporated herein by reference thereto.

BACKGROUND OF THE INVENTION

The present invention concerns an air inlet cover for a fan. Such inlet covers are often provided over air inlets to fans, in order to prevent users from accidentally or deliberately inserting their fingers into a fan when it is running, thereby injuring themselves, as well as in order to prevent users from accidentally or deliberately inserting other, more robust probes into the fan when it is running, thereby damaging the fan. Often when a fan forms part of a consumer product, such an air inlet cover to the fan is required by government safety legislation.

Typically, air inlet covers take the form of a grille, wherein the spacing between adjacent elements of the grille is made less than a certain size, for example the approximate diameter of a human finger. If the air inlet cover is required by government safety legislation, this maximum probe size may be specified by the legislation itself. However, such inlet covers, although advantageous from a consumer safety point of view, have the disadvantage that they also impede the flow of air into the fan, thereby affecting the efficiency of the fan adversely when the fan is running. This happens in at least two ways: firstly, by reducing the overall volume of air reaching the fan per second, but also by creating turbulence in the ingoing airflow. Ideally, the air entering the fan should be flowing smoothly, a condition known to aerodynamicists as laminar flow.

Accordingly, there have been several proposals already adopted in the known art to improve the flow of air to a fan through an air inlet cover. A first known solution is to provide the air inlet cover with a bell-shaped mouth, which directs incoming air towards the grille of the air inlet. Such a bell-shaped mouth increases the overall volume of air reaching the fan per second when it is running, thereby increasing the fan's efficiency, relative to a fan having an air inlet cover but no bell-shaped mouth, because the cross-sectional area of the bell-shaped mouth further from the fan is greater than the cross-sectional area of the bell-shaped mouth nearer to the fan. Thus a volume of air entering the bell-shaped mouth through its wider end is compressed into a smaller volume at its narrower end, thereby increasing the volume of air reaching the fan when it is running, and thus the fan's efficiency. However, this first known solution has the disadvantage that it increases the overall distance of the air inlet from the wider end of the bell-shaped mouth to the fan, thereby taking up more space, and therefore the amount of material required, and also the cost, to manufacture the air inlet and fan assembly.

A second known solution to improve the flow of air to a fan through an air inlet cover is to provide the fan with a gap separating the air inlet cover from the fan. This gap allows eddies of turbulent flow in incoming air generated by the grille of the air inlet cover to dissipate before the incoming air reaches the fan, thereby making the flow of air entering the fan more laminar. However, once again, this second known solution also has the disadvantage that it increases the overall distance of the air inlet to the fan, thereby taking up more space, and therefore the amount of material required, and also the cost, to manufacture the air inlet and fan assembly.

Accordingly, in order to address these size, material and cost disadvantages with the known solutions for improving the flow of air to a fan through an air inlet cover, in a first aspect, the present invention provides an air inlet cover comprising a grille having a plurality of radial elements radiating from a center of said grille, each said radial element comprising a vane having a leading edge for positioning further from a fan and a trailing edge for positioning closer to a fan, the leading edge of each said vane being offset from the respective trailing edge thereof by substantially the same angular amount for each said vane, whereby the vanes are pitched more steeply closer to the center of said grille than remote from the center of said grille, and a circumferential element comprising a bell-shaped mouth enclosing said vanes and having a plurality of apertures formed in a surface thereof, each respective one of said apertures having a first edge parallel to the pitch of a first respective vane closer to the center of said grille and a second edge parallel to the pitch of a second, adjacent respective vane remote from the center of said grille.

In this way, when the fan is running, air entering the air inlet cover is deflected by an angled face of each vane between the leading and the trailing edges thereof and is directed towards the fan in a vortex having its eye located at the center of the grille. Since the vanes are pitched more steeply closer to the center of the grille than remotely from its center, the angle of deflection of the incoming air is greater towards the outer circumference of the grille, where the rotational velocity of the fan is greatest, and is less nearer to the center of the grille, where the air passes substantially axially straight through the grille with only minimal deflection and the rotational velocity of the fan is least. Thus both the direction and the magnitude of the velocity of the incoming air is aligned with the direction and magnitude of the rotational velocity of the fan across the width of the fan, with incoming air towards the outside of the fan being imparted with a larger tangential velocity component than incoming air near the center of the grille, which has a larger axial component, where the rotational velocity of the fan is least. Moreover, since the incoming air is directed by the angled face of each vane in this manner, the air tends to form a more laminar flow than if it were to pass through a grille of negligible thickness, in the manner of the prior art.

On the other hand, the feature that the vanes are enclosed within a bell-shaped mouth means that the bell-shaped mouth does not add substantially to the overall thickness of the air inlet cover defined by the vanes themselves, which would otherwise be the case if the vanes on the one hand and the bell-shaped mouth on the other were formed in series with one another.

Finally, the fact that the bell-shaped mouth also has a plurality of apertures formed in the surface thereof increases the overall volume of air reaching the fan, which is able to pass directly through these apertures towards the outer circumference of the fan. Since these apertures are formed such that each respective one has a first edge parallel to the pitch of a first respective vane closer to the center of the grille and a second edge parallel to the pitch of a second respective vane remote from the center of the grille, the bell-shaped mouth presents the least possible obstruction to the incoming air consistent with supporting a circumferential edge of each vane. The combination of all of these features is found to result in an air inlet cover which gives a fan it is covering an efficiency when running which is little distinguishable from the efficiency of the same fan running in open air, and significantly improved in comparison to the air inlet covers of the prior art.

BRIEF SUMMARY OF THE INVENTION

In a preferred embodiment, the leading edge of each vane of the inlet cover has a width substantially equal to the width of the trailing edge of the same respective vane, such that the width of the vanes is substantially uniform across their depth. This allows the air inlet cover to be moulded very simply using only open-and-shut tooling.

Optionally, the air inlet cover may be provided with one or more further elements concentric with the circumferential element. These help to prevent probe access through the inlet cover to the fan by dividing up the spaces between the vanes of the inlet cover further. If each further concentric element has a depth equal to or less than a depth of the circumferential element, then the overall thickness of the air inlet cover is not increased thereby. Moreover, if each further concentric element is oriented across its entire depth and around its entire length at right angles to the trailing edge of the radial elements, in the manner of a right-circular cylinder, then provided that the leading edge of each vane also has a width substantially equal to the width of the trailing edge of the same respective vane, the inlet cover may still be moulded very simply using only open-and-shut tooling.

If desired, or required by legislation, probe access through the inlet cover to the fan may be further restricted, without significantly affecting the performance of the inlet cover, by providing the plurality of apertures formed in the circumferential element with a bar formed across each said respective aperture.

In a second aspect, the present invention also provides a power tool comprising a fan and an air inlet cover according to the first aspect of the invention. The power tool may be a garden leaf blower or a dust extraction machine, including a domestic vacuum cleaner. If the angular amount by which the leading edge of each vane of the inlet cover is offset from the respective trailing edge thereof is matched to the angular velocity of the fan when the fan is running, the performance of the air inlet cover and the efficiency of the fan covered thereby may be optimised. Thus a fan running at a higher angular velocity can be matched to an air inlet cover with an offset of a larger angular amount, leading to vanes of a more shallow pitch which deflect incoming air more tangentially, whereas a fan running at a lower angular velocity can be matched to an air inlet cover with an offset of a smaller angular amount, leading to vanes of a steeper pitch which deflect incoming air by a lesser amount, allowing it to pass more axially into the more slowly moving fan. A person of ordinary skill in the art may determine the exact angle of offset appropriate to a particular fan speed very simply by trial and error, adjusting the angular velocity of the fan to a particular offset angle until the efficiency of the fan is optimised.

BRIEF DESCRIPTIONS OF THE DRAWINGS

Further features and advantages of the present invention will be better understood by reference to the following detailed description of the invention, which is given by way of example and in association with the accompanying drawings, in which.

DETAILED DESCRIPTION OF THE INVENTION

Figure 1:
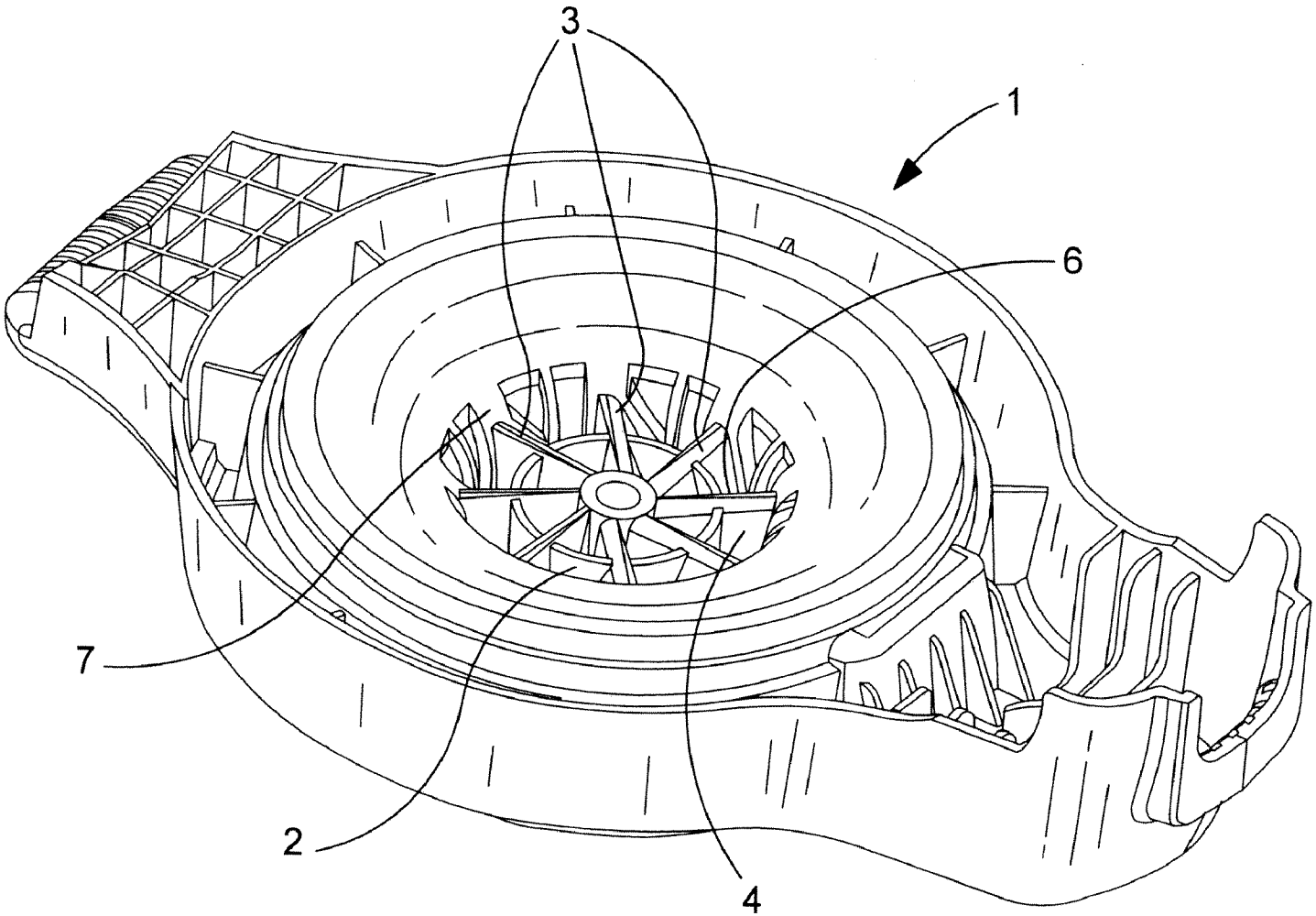
FIG. 1 is a perspective view of an interior surface of an air inlet cover according to an embodiment of the invention, showing the trailing edge of the vanes thereof topmost.

Referring firstly to FIG. 1, there is shown a perspective view of an interior surface of an air inlet cover according to an embodiment of the invention. The air inlet cover 1 comprises a grille 2 having a plurality of radial elements 3. Visible in FIG. 1 is a trailing edge 6 and a vane 4 of one of the radial elements 3. There may also be seen a circumferential element 7 comprising a bell-shaped mouth which encloses the vanes 4.

Figure 2:
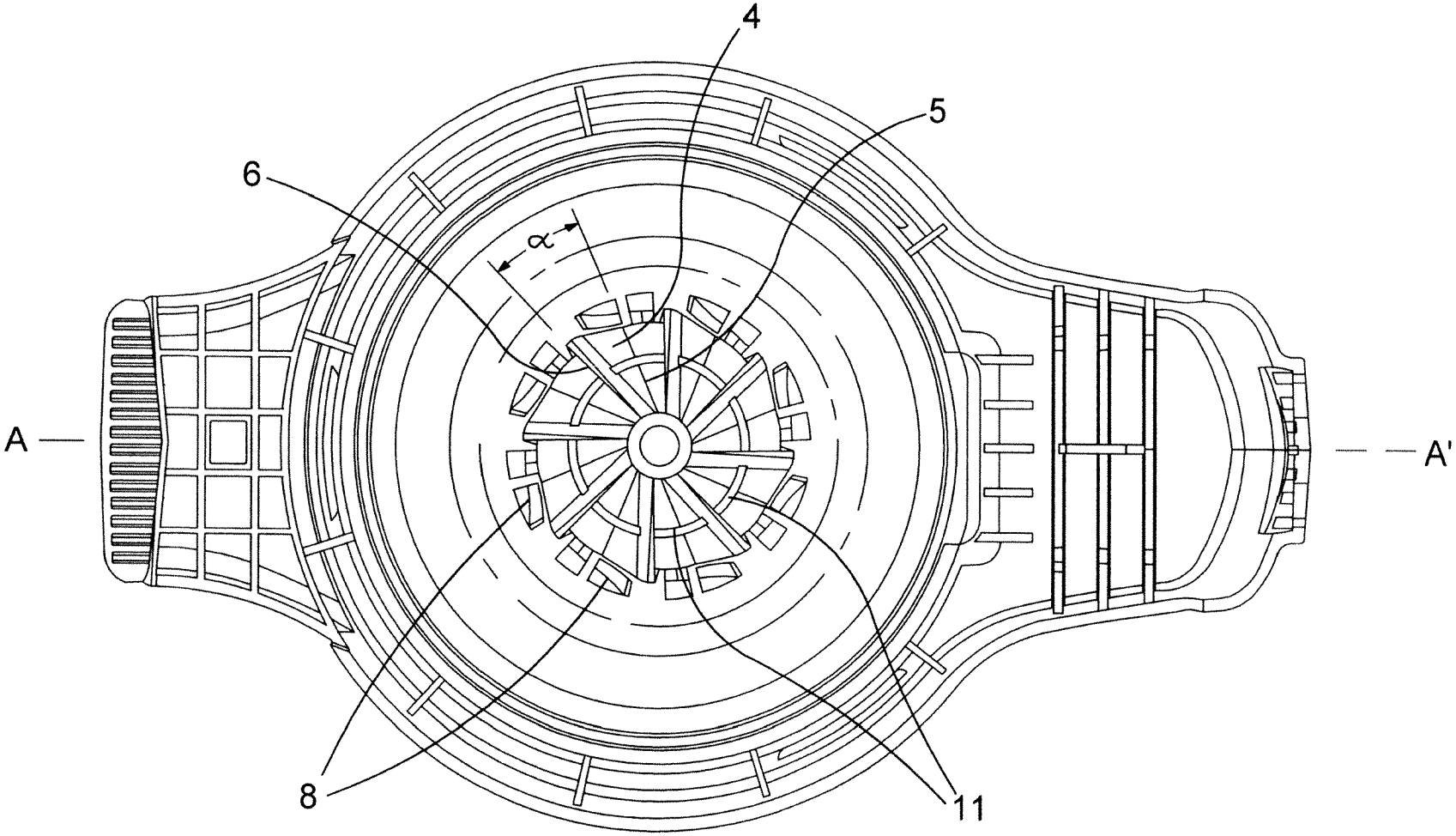
FIG. 2 is a plan view of the interior surface of the air inlet cover of FIG. 1.

FIG. 2 is a plan view of the same interior surface of the air inlet cover of FIG. 1. Here, there may be seen the angular amount a by which the leading edge 5 of each vane 4 is offset from the trailing edge 6 thereof. There may also be seen a plurality of apertures 8 formed in a surface of the circumferential element 7, as well as a further element 11 concentric with the circumferential element 7. As may be seen from this plan view, the concentric element 11 is oriented across its entire depth and around its entire length at right angles to the trailing edges 6 of the radial elements 3, in the manner of a right-circular cylinder.

Figure 3:
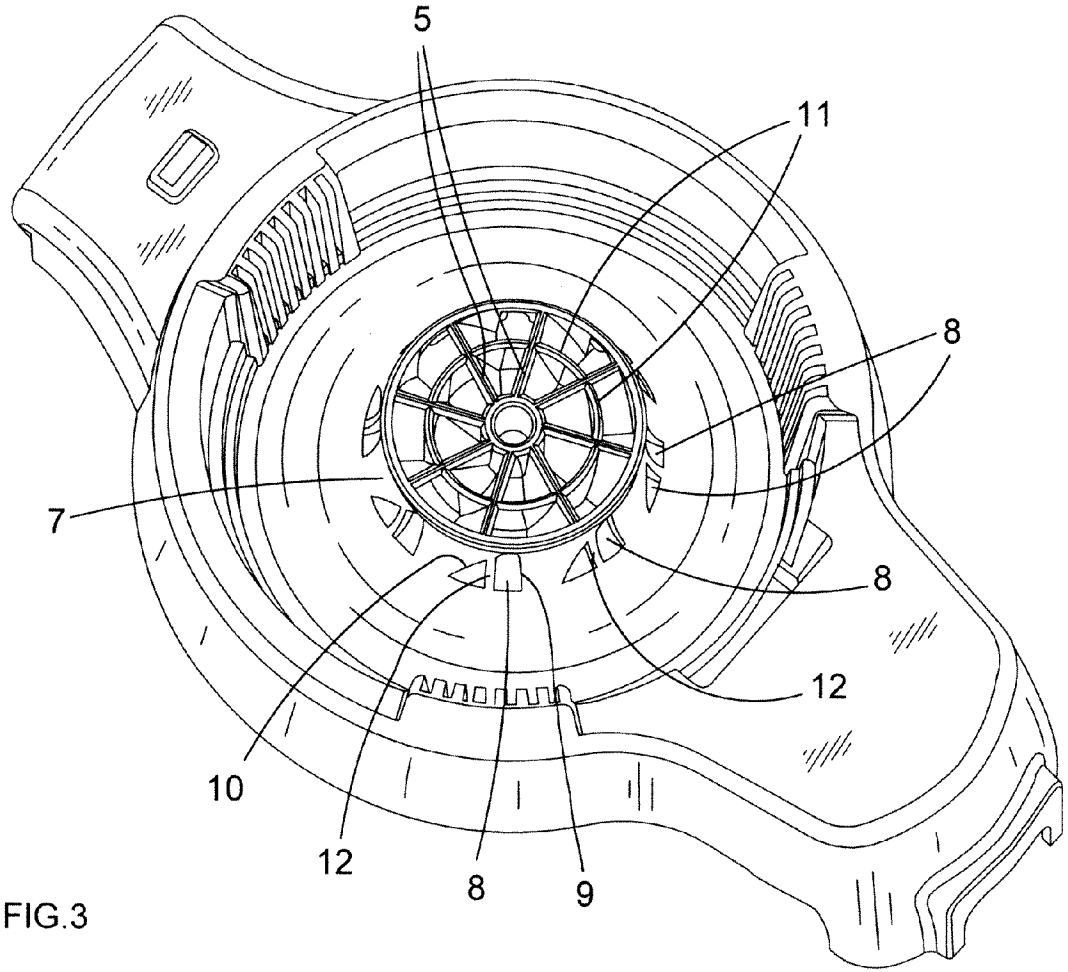
FIG. 3 is a perspective view of an exterior surface of the air inlet cover of FIG. 1, showing the leading edge of the vanes thereof topmost.

FIG. 3 is a perspective view of an exterior surface of the air inlet cover of FIG. 1. The leading edges 5 of the radial elements 3 are now more visible, as is the concentric element 11. FIG. 3 also shows how the apertures 8 formed in the circumferential element 7 have a first edge 9 parallel to the pitch of a first respective vane closer to the center of the grille 2 and a second edge 10 parallel to the pitch of a second, adjacent respective vane remote from the center of the grille. FIG. 3 also shows how each such aperture 8 is also provided with a bar 12 formed across it, in order to limit probe access through the apertures 8.

Figure 4:
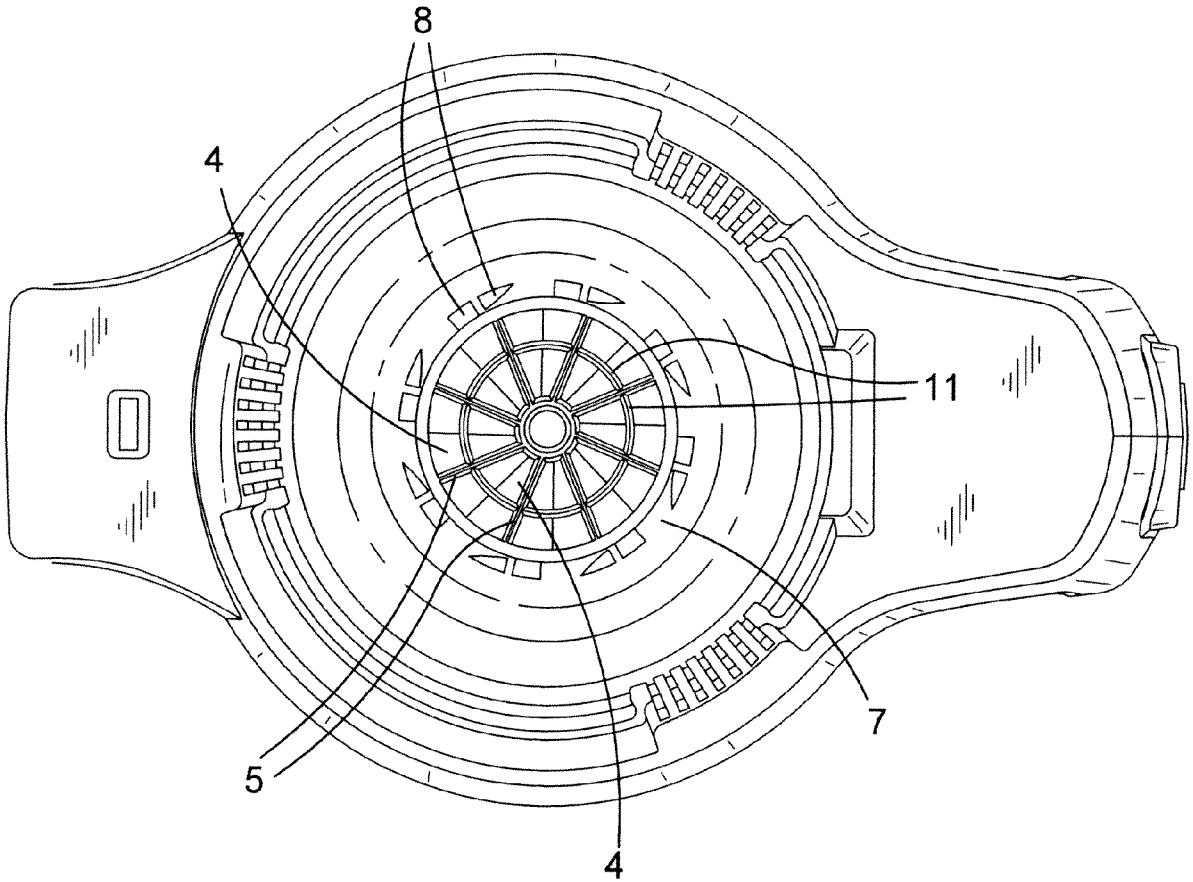
FIG. 4 is a plan view of the exterior surface of the air inlet cover of FIG. 3.

FIG. 4 is a plan view of the exterior surface of the air inlet cover of FIG. 3. As may be seen by comparing FIG. 4 with FIG. 2, the width of the leading edge 5 of each vane 4 is substantially the same as the width of the trailing edge 6 of each vane. Since the concentric element 11 is also oriented across its entire depth and around its entire length at right angles to the trailing edges 6 of the radial elements 3, in the manner described above in relation to FIG. 2, this allows the air inlet cover 1 of this embodiment to be moulded using only open-and-shut tooling.

Figure 5:
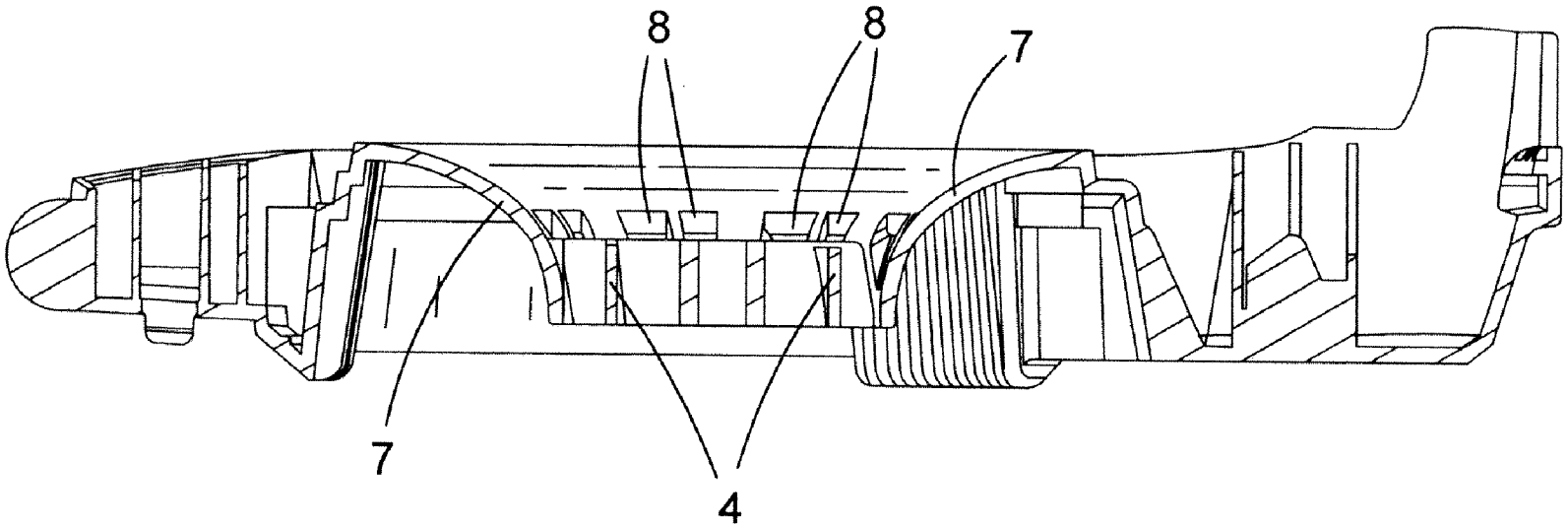
FIG. 5 is a longitudinal sectional view through the air inlet cover of FIGS. 1 to 4 along the line A-A' marked in FIG. 2.

FIG. 5 is a sectional view through the air inlet cover of this embodiment along the line A-A' shown in FIG. 2, clearly showing the bell-shaped mouth of the circumferential element 7 which encloses the vanes 4, some of which may also be seen in section. FIG. 5 also clearly shows the apertures 8 formed in the circumferential element 7.

Figure 6:
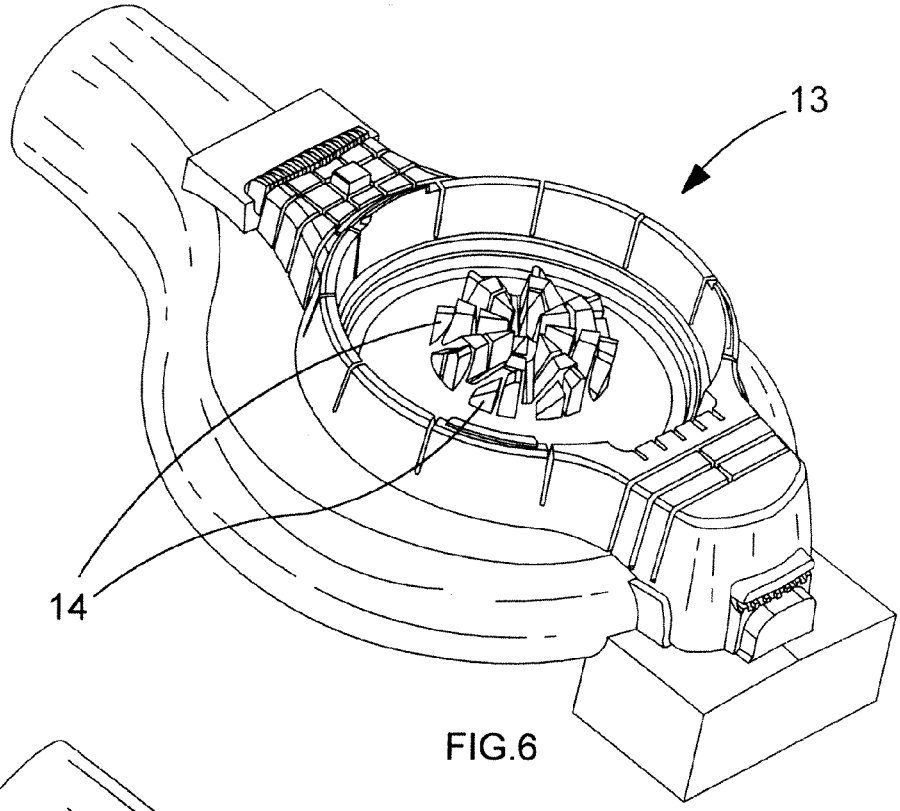
FIG. 6 is a first perspective view of a first open-and-shut tool for moulding the air inlet cover of FIGS. 1 to 5.
Figure 7:
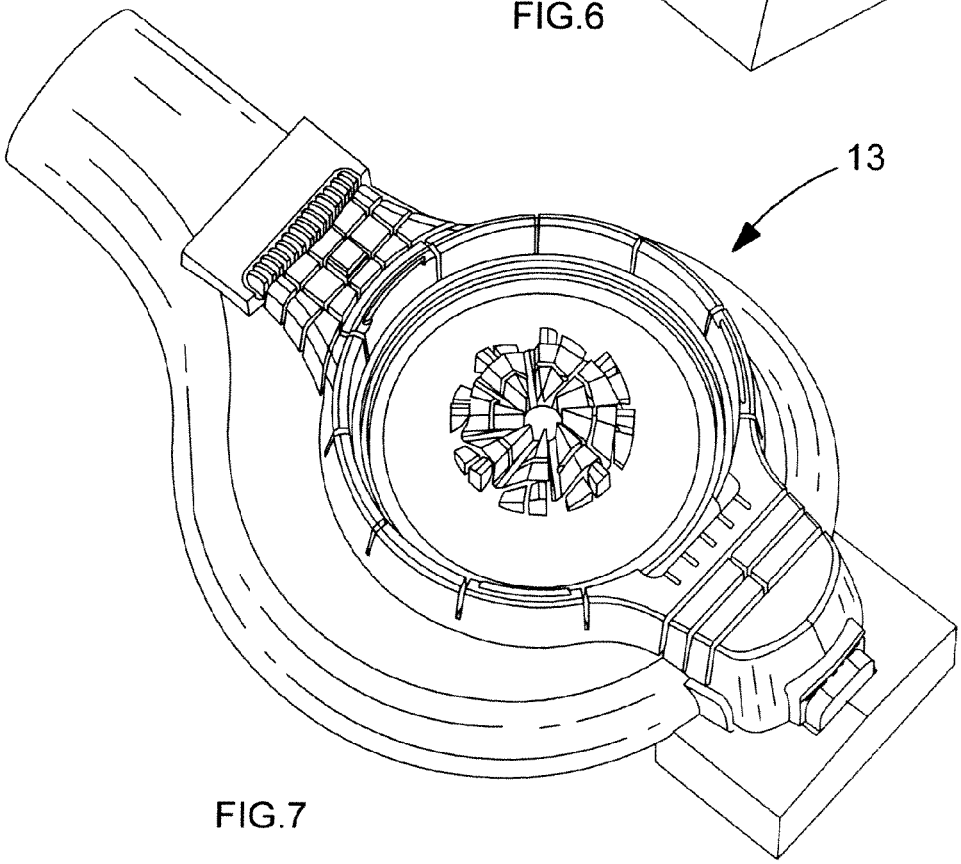
FIG. 7 is a second perspective view of the first open-and-shut tool of FIG. 6.

FIG. 6 is a first perspective view of a first open-and-shut tool 13 for moulding the air inlet cover 1 of FIGS. 1 to 5. As may be seen from FIG. 6, this first open-and-shut tool 13 comprises a first plurality of core elements 14 shaped so as to create the spaces between radial elements 3, circumferential element 7 and further concentric element 11 when air inlet cover 1 is moulded using tool 13. FIG. 7, which displays the same tool 13 from a different viewing angle, shows more clearly how the pitch of the core elements 14 varies from the periphery of said core elements towards their middle. This variation in pitch helps to create the angular offset a between the leading edge 5 of each vane 4 of the air inlet cover and the respective trailing edges 6 thereof when the air inlet cover is moulded.

Figure 8:
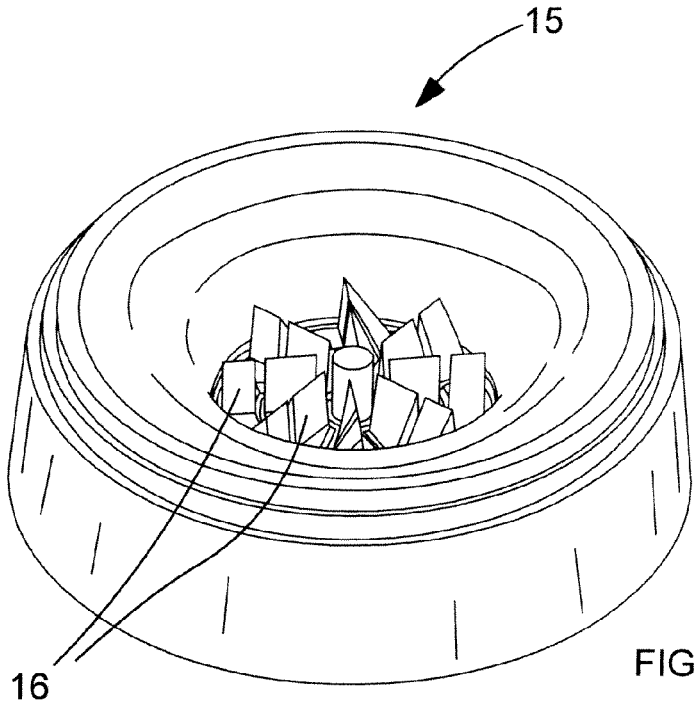
FIG. 8 is a first perspective view of a second open-and-shut tool for use with the first open-and-shut tool of FIGS. 6 and 7 in moulding the air inlet cover of FIGS. 1 to 5.
Figure 9:
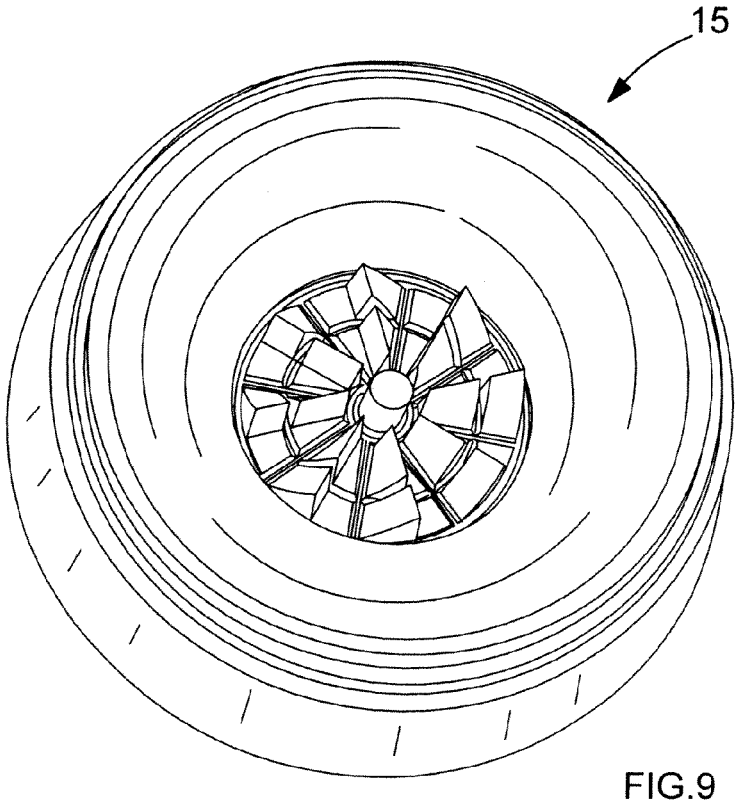
FIG. 9 is a second perspective view of the second open-and-shut tool of FIG. 8.

FIG. 8 shows a first perspective view of a second open-and-shut tool 15 which is complementary to the first open-and-shut tool 13 and for use therewith in moulding the air inlet cover 1. This second tool 15 comprises a second plurality of core elements 16 which interact with the first plurality of core elements 14 of tool 13 to create the elements of the grille 2 in the spaces left between the first and second core elements 14, 16. Finally, FIG. 9 shows the same tool 15 from a different viewing angle, revealing more clearly how the pitch of the core elements 16 varies from the periphery of said core elements towards their middle, thereby helping to create the angular offset a as described above in relation to FIG. 7.

The invention claimed is:

1. An air inlet cover comprising a grille having: a plurality of radial elements radiating from a center of said grille, each said radial element comprising a vane having a leading edge for positioning further from a fan and a trailing edge for positioning closer to a fan, the leading edge of each said vane being offset from the respective trailing edge thereof by substantially the same angular amount for each said vane, whereby the vanes are pitched more steeply closer to the center of said grille than remote from the center of said grille, and a circumferential element comprising a bell-shaped mouth enclosing said vanes and having a plurality of apertures formed in a surface thereof, each respective one of said apertures having a first edge parallel to the pitch of a first respective vane closer to the center of said grille and a second edge parallel to the pitch of a second, adjacent respective vane remote from the center of said grille.

2. The air inlet cover according to claim 1, wherein the leading edge of each said vane has a width substantially equal to the width of the trailing edge thereof, such that the width of said vanes is substantially uniform across their depth.

3. The air inlet cover according to claim 1, further comprising a concentric element that intersect an intermediate portion of the radial element.

4. The air inlet cover according to claim 3, wherein the concentric element has a depth equal to or less than a depth of the circumferential element and contacts the trailing edge of the radial elements at a right angle.

5. The air inlet cover according to claim 1, wherein the plurality of apertures formed in the circumferential element each comprise a bar formed across each said respective aperture.

6. A power tool comprising:

a fan;

an air inlet cover having a grill located over said fan; and the grill having a plurality of radial elements radiating from a center of said grille, each said radial element comprising a vane having a leading edge for positioning further from a fan and a trailing edge for positioning closer to a fan, whereby the vanes are pitched more steeply closer to the center of said grille than remote from the center of said grille, wherein the pitch is the angle of the vane between its leading edge and trailing edge.

7. The power tool according to claim 6 further comprising a circumferential element comprising a bell-shaped mouth enclosing said vanes and having a plurality of apertures formed in a surface thereof, each respective one of said apertures having a first edge parallel to the pitch of a first respective vane closer to the center of said grille and a second edge parallel to the pitch of a second, adjacent respective vane remote from the center of said grille.

8. The power tool according to claim 7, further comprising a concentric element that intersect an intermediate portion of the radial element.

9. The air inlet cover according to claim 8, wherein the concentric element has a depth equal to or less than a depth of the circumferential element and contacts the trailing edge of the radial elements at a right angle.

10. The power tool according to claim 6, wherein the tool is a garden leaf blower or a dust extraction machine, including a domestic vacuum cleaner.

11. The power tool according to claim 6, wherein the leading edge of each said vane has a width substantially equal to the width of the trailing edge thereof, such that the width of said vanes is substantially uniform across their depth.

* * * * *